US011311164B2

(12) United States Patent
Machida et al.

(10) Patent No.: US 11,311,164 B2
(45) Date of Patent: Apr. 26, 2022

(54) ELECTRICAL EQUIPMENT USING BATTERY AS POWER SUPPLY AND VACUUM CLEANER

(71) Applicant: Toshiba Lifestyle Products & Services Corporation, Kawasaki (JP)

(72) Inventors: Yukio Machida, Aichi (JP); Yusuke Abe, Aichi (JP); Naoko Shinagawa, Aichi (JP); Takayoshi Shimizu, Aichi (JP); Fumiki Mano, Kanagawa (JP)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 275 days.

(21) Appl. No.: 16/263,009

(22) Filed: Jan. 31, 2019

(65) Prior Publication Data

US 2019/0159643 A1 May 30, 2019

Related U.S. Application Data

(63) Continuation of application No. PCT/JP2017/028107, filed on Aug. 2, 2017.

(30) Foreign Application Priority Data

Aug. 3, 2016 (JP) ..... JP2016-153033

(51) Int. Cl.
*A47L 9/28* (2006.01)
*A47L 9/32* (2006.01)
*A47L 9/00* (2006.01)

(52) U.S. Cl.
CPC ..... *A47L 9/2889* (2013.01); *A47L 9/28* (2013.01); *A47L 9/2884* (2013.01); *A47L 9/325* (2013.01); *A47L 9/009* (2013.01)

(58) Field of Classification Search
CPC ..... A47L 9/009; A47L 9/28; A47L 9/2857; A47L 9/2884; A47L 9/2889; A47L 9/322; A47L 9/325
See application file for complete search history.

(56) References Cited

U.S. PATENT DOCUMENTS 3,711,742 A * 1/1973 Pinkham, Jr. ..... H05F 3/00 361/212
4,715,086 A * 12/1987 Johanson ..... A47L 9/2889 15/339

(Continued)

FOREIGN PATENT DOCUMENTS

CN 204498452 U 7/2015
CN 103356134 B * 9/2015
DE 299 14 687 U1 12/1999
DE 102 41 129 A1 12/2003

(Continued)

OTHER PUBLICATIONS

International Search Report dated Oct. 24, 2017 in PCT/JP2017/028107 filed on Aug. 2, 2017.

*Primary Examiner* — Marc Carlson
(74) *Attorney, Agent, or Firm* — Oblon, McClelland, Maier & Neustadt, L.L.P.

(57) ABSTRACT

A vacuum cleaner includes a main body portion, a secondary battery, an electric blower, a handle and a conductive member. The secondary battery is disposed in the main body portion. The electric blower operates by electric power supply from the secondary battery. The handle is one which a user contacts when the vacuum cleaner is used. At least a part of the conductive member is disposed at the handle and conducts static electricity generated due to operation of the electric blower.

15 Claims, 12 Drawing Sheets

(56) References Cited

U.S. PATENT DOCUMENTS

| | | | | |
|---|---|---|---|---|
| 6,301,743 | B1 * | 10/2001 | Cloud, III | A47L 9/2842 15/339 |
| 6,552,891 | B1 * | 4/2003 | Prach | A47L 5/14 361/212 |
| 10,992,207 | B2 * | 4/2021 | Eshleman | H02K 11/26 |
| 2008/0127450 | A1 * | 6/2008 | Hawkins | A47L 9/0494 15/389 |
| 2011/0000048 | A1 * | 1/2011 | Yamazaki | F02B 63/06 15/405 |
| 2013/0255030 | A1 * | 10/2013 | Meredith | A47L 7/0004 15/347 |
| 2016/0174801 | A1 | 6/2016 | Conrad | |
| 2019/0029487 | A1 * | 1/2019 | Zhou | A47L 5/26 |
| 2020/0297177 | A1 * | 9/2020 | Zhu | A47L 9/28 |

FOREIGN PATENT DOCUMENTS

| | | | | | |
|---|---|---|---|---|---|
| EP | 2 957 207 | A1 | | 12/2005 | |
| JP | 1-259825 | | | 10/1989 | |
| JP | 8-279398 | A | | 10/1996 | |
| JP | 3059443 | U | | 3/1999 | |
| JP | 3059443 | | | 7/1999 | |
| JP | 2006-272019 | | | 10/2006 | |
| JP | 2006-272019 | A | | 10/2006 | |
| JP | 2007236426 | A | * | 9/2007 | |
| JP | 2012-192007 | | | 10/2012 | |
| JP | 2012-192007 | A | | 10/2012 | |
| JP | 2016-123746 | A | | 7/2016 | |
| JP | 2016-131744 | A | | 7/2016 | |
| JP | 2017185036 | A | * | 10/2017 | |
| JP | 2017195036 | A | * | 10/2017 | |
| WO | WO-2016138961 | A1 | * | 9/2016 | B25F 5/02 |

* cited by examiner

ELECTRICAL EQUIPMENT USING BATTERY AS POWER SUPPLY AND VACUUM CLEANER

CROSS-REFERENCE TO RELATED APPLICATIONS

This application is a continuation of prior International Patent Application No. PCT/JP2017/028107 filed on Aug. 2, 2017, which is based upon and claims the benefit of priority from Japanese Patent Application No. 2016-153033 filed on Aug. 3, 2016, the entire contents of which are herein incorporated by reference.

FIELD

Embodiments of the present invention relate to electrical equipment using a battery as a power supply and a vacuum cleaner.

BACKGROUND

Conventionally, a vacuum cleaner which sucks and collects dust into a dust collecting unit by using negative pressure generated by driving an electric blower is known, for example. Such a vacuum cleaner is configured such that an air duct body provided with a hose body, an extension pipe etc. is connected to a main body of the cleaner which accommodates an electric blower, for example, and the dust is suctioned into the dust collecting unit through an inner portion of the air duct body. Accordingly, static electricity is generated due to friction between the air duct body and the dust passing through the inner portion of the air duct body. In a case of a wired vacuum cleaner using an external power supply such as a commercial AC power supply, static electricity can be grounded to the power supply via an electrical outlet on a wall surface etc. by means of a power supply line. However, in a case of a vacuum cleaner using an internal power supply such as a secondary battery, static electricity cannot be released with ease.

DETAILED DESCRIPTION

According to one embodiment, electrical equipment which has a main body portion, a battery, an operating unit, a human body contacting portion and a conductive member is provided. The battery is disposed in the main body portion. The operating unit operates by electric power supply from the battery. The human body contacting portion is one which a user contacts when the electrical equipment is used. At least a part of the conductive member is disposed at the human body contacting portion and conducts static electricity generated due to operation of the operating unit.

Hereinafter, further embodiments will be described with reference to the drawings. A configuration of a first embodiment will be described with reference to FIGS. 1 to 8.

Figure 7:
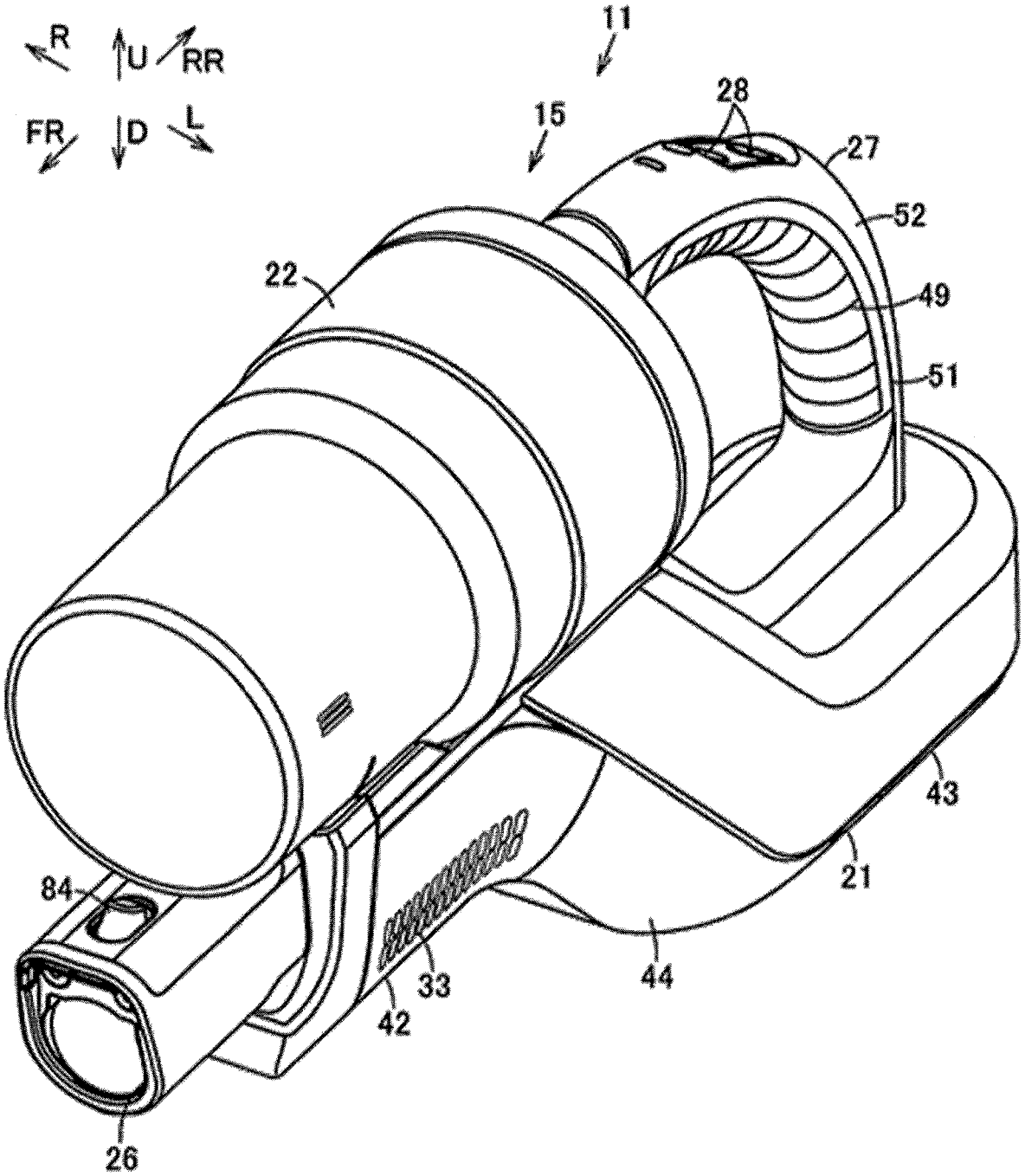
FIG. 7 is a perspective view illustrating one use state of the vacuum cleaner.
Figure 8:
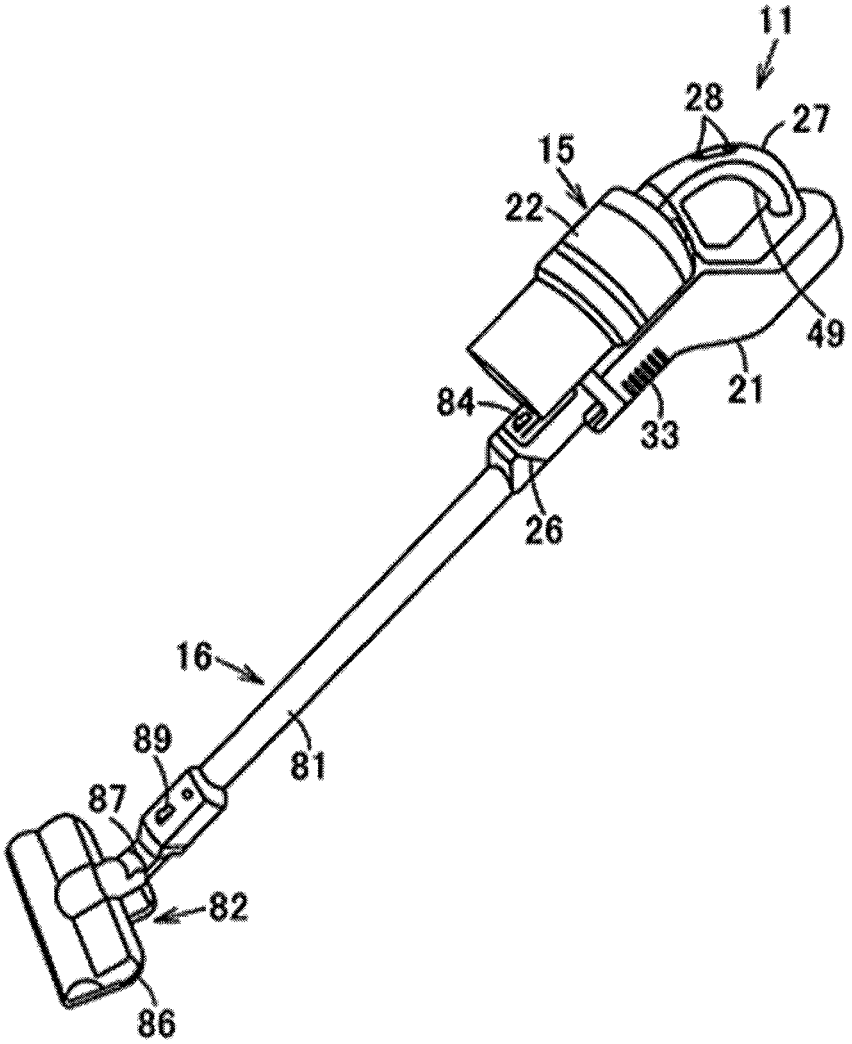
FIG. 8 is a perspective view illustrating another use state of the vacuum cleaner.

In FIG. 8, 11 denotes a vacuum cleaner as electrical equipment. The vacuum cleaner 11 is provided with a cleaner main body 15. The vacuum cleaner 11 may be provided with an elongated air duct body 16 connected to the cleaner main body 15. The vacuum cleaner 11 is used as a handy (portable) cordless suction vacuum cleaner in one use state (FIG. 7) which is a predetermined use state using the cleaner main body 15 only. In a case where the vacuum cleaner 11 is provided with the air duct body 16, the vacuum cleaner 11 can be used as a stick-type cordless suction vacuum cleaner in another use state (FIG. 8) in which the air duct body 16 is connected to the cleaner main body 15. The vacuum cleaner 11 may constitute an electric cleaning device together with a storage device (not illustrated) for storing the vacuum cleaner 11 when the vacuum cleaner 11 is not used.

Figure 6:
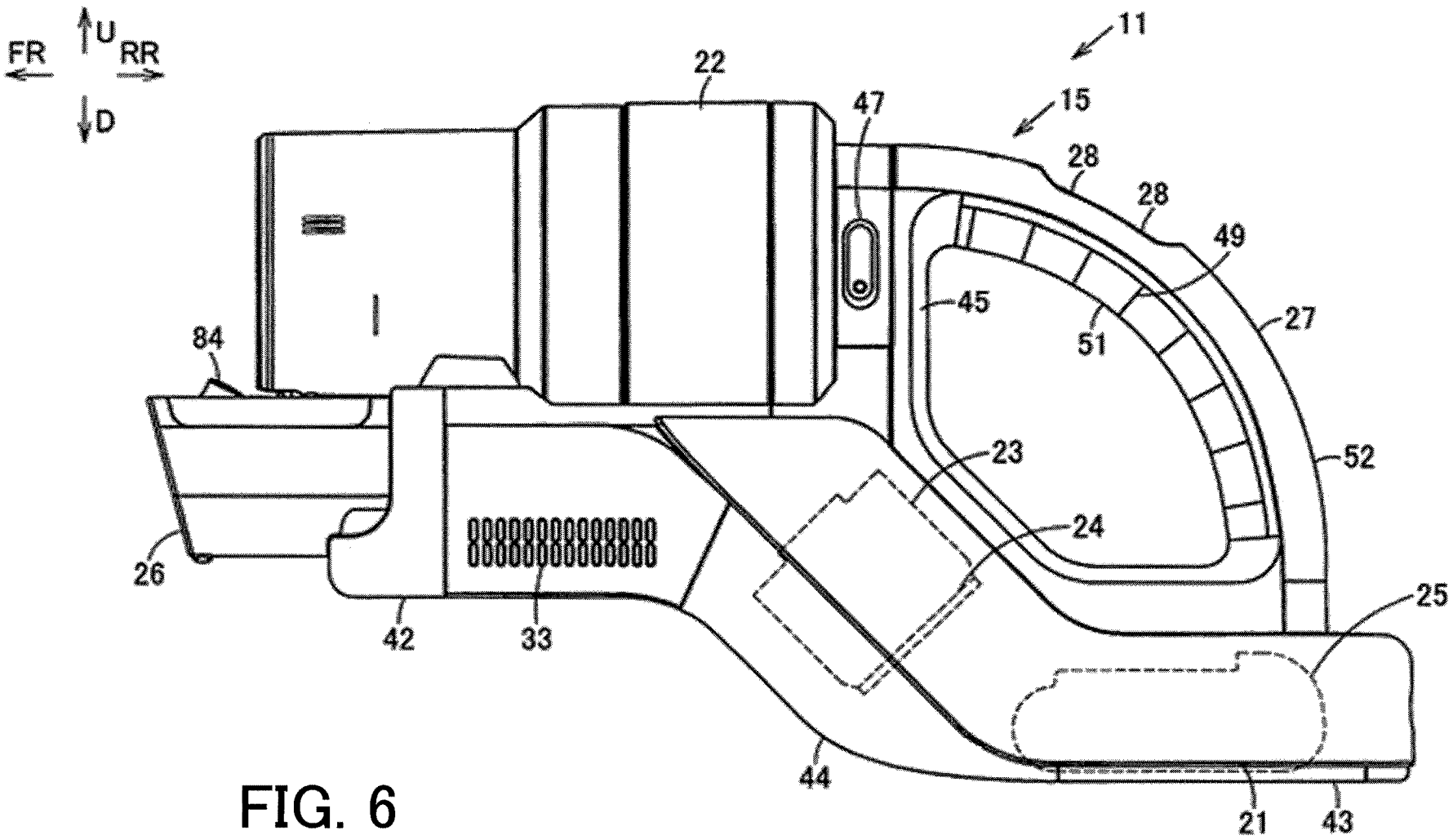
FIG. 6 is a side view of the vacuum cleaner.

The cleaner main body 15 illustrated in FIG. 6 is provided with a main body portion 21. The cleaner main body 15 is also provided with a dust collecting unit (dust collecting device) 22 which is detachable from the main body portion 21. Further, the cleaner main body 15 is provided with an electric blower 23 as an operating unit. The cleaner main body 15 is provided with a control device (control unit) 24 to control the operation of the electric blower 23. Further, the cleaner main body 15 is provided with a secondary battery 25 which is a battery serving as a power supply unit to supply electric power to the electric blower 23, the control device 24 etc. The cleaner main body 15 is provided with a main body connection port 26 which allows the air duct body 16 to be connected.

Figure 1:
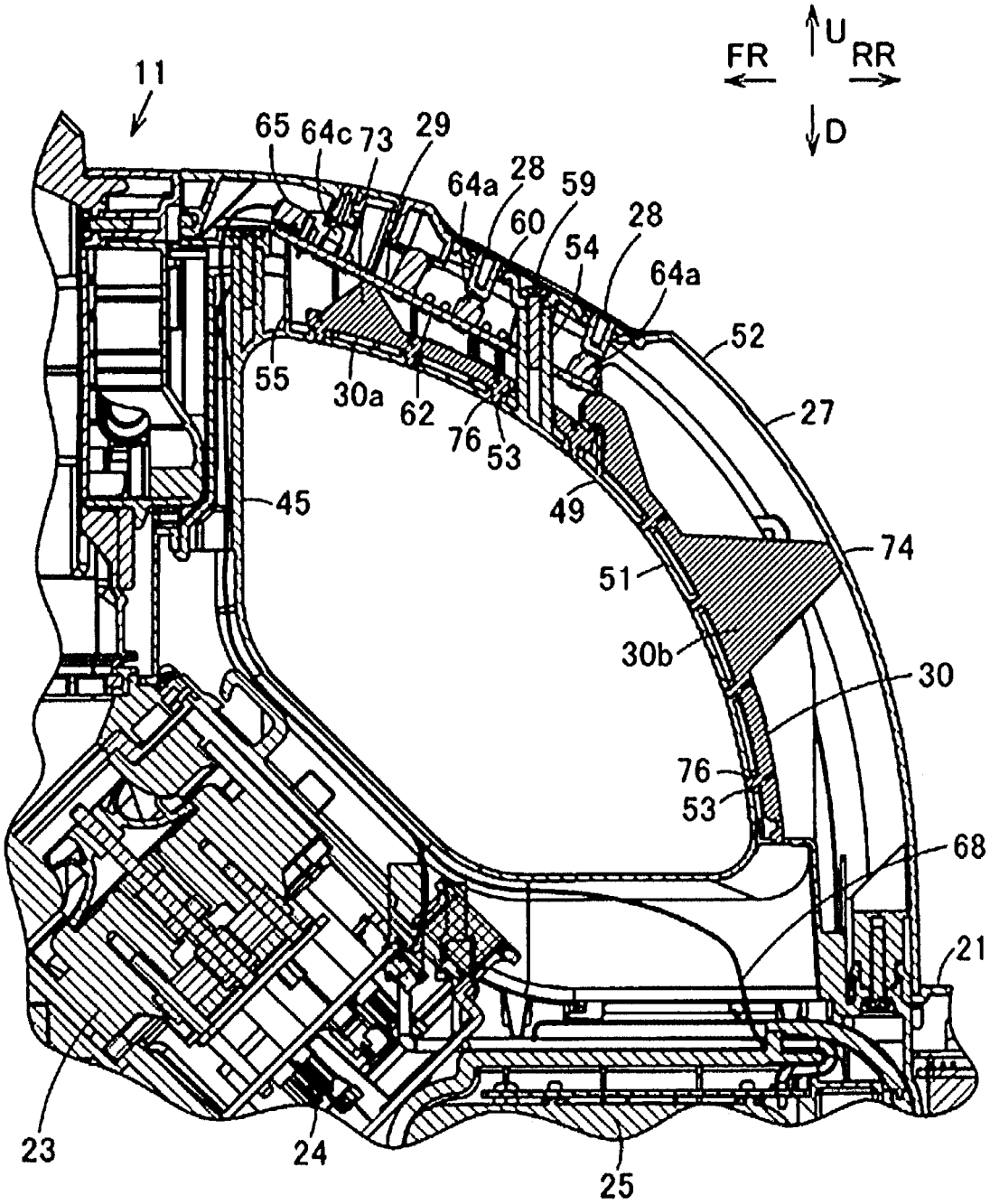
FIG. 1 is a cross-sectional view illustrating a part of a vacuum cleaner as electrical equipment according to a first embodiment.

The cleaner main body 15 is provided with a handle (a gripping portion) 27 which is a main body holding portion as a human body contacting portion for holding the cleaner main body 15 (a vacuum cleaner 11). The cleaner main body 15 is provided with setting buttons 28 as a setting device for setting operation modes of the electric blower 23. The cleaner main body 15 is provided with a circuit board 29 as illustrated in FIG. 1. The cleaner main body 15 is provided with a conductive member 30. The cleaner main body 15 is provided with a first communication port (not illustrated) and a second communication port (not illustrated).

Each of the first communication port and the second communication port communicates with the dust collecting unit 22 illustrated in FIG. 6. The cleaner main body 15 is provided with an exhaust port 33 to discharge the exhaust of the electric blower 23. An air duct is formed in the cleaner main body 15 such that the main body connection port 26 and the first communication port communicate with each other, the second communication port and a suction side of the electric blower 23 communicate with each other, and an exhaust side of the electric blower 23 and the exhaust port 33 communicate with each other.

Regarding the vacuum cleaner 11, in the following description, a direction substantially parallel to an axis of the main body connection port 26 is defined as a forward-rearward direction, and upward-downward and leftward-rightward directions are defined with reference to the forward-rearward direction, in order that the description can be further clarified. As for the upward-downward direction, the leftward-rightward direction and the forward-rearward direction of the vacuum cleaner 11, an arrow U direction is defined as the upward direction, an arrow D direction is defined as the downward direction, an arrow FR direction is defined as the forward direction, an arrow RR direction is defined as the rearward direction, an arrow L direction is defined as the leftward direction, and an arrow R direction is defined as the rightward direction, respectively with reference to the state illustrated in FIG. 6.

Figure 2:
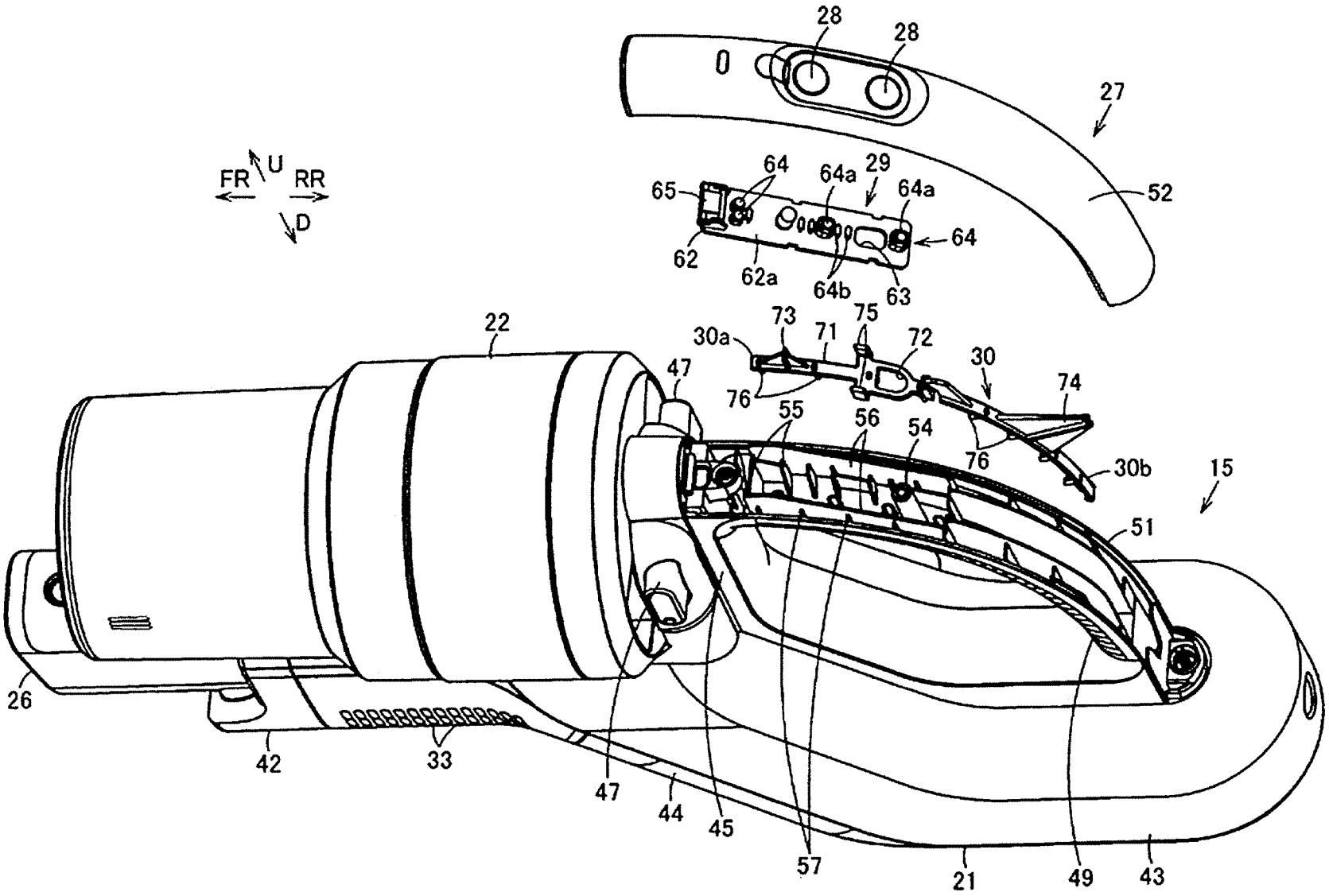
FIG. 2 is an exploded perspective view illustrating a part of the vacuum cleaner.

The main body portion 21 is illustrated in FIG. 6. The main body portion 21 as a whole is formed so as to be elongated in the forward-rearward direction. As described above, the main body portion 21 accommodates each of the electric blower 23, the control device 24 and the secondary battery 25. The main body connection port 26 is open in the main body portion 21. Further, the handle 27 protrudes from the main body portion 21. The circuit board 29 is accommodated in the main body portion 21 as illustrated in FIGS. 1 and 2. The conductive member 30 is accommodated in the main body portion 21. The first communication port and the second communication port are open in the main body portion 21. Further, the exhaust port 33 is open in the main body portion 21. The main body portion 21 is provided with an air duct. The main body portion 21 is provided with a first main body portion 42 positioned in the front portion and extending along the forward-rearward direction, a second main body portion 43 positioned in the rear portion and extending along the forward-rearward direction, and an inclined main body portion 44 as a connecting main body portion which connects the first main body portion 42 and the second main body portion 43. The main body portion 21 is provided with an attachment holding portion 45 where the dust collecting unit 22 is attached and held.

As illustrated in FIG. 6, the first main body portion 42 is formed in a substantially linear shape along the forward-rearward direction. The second main body portion 43 is positioned below the first main body portion 42. The second main body portion 43 is linearly formed along the forward-rearward direction. Accordingly, the second main body portion 43 is substantially formed in parallel to the first main body portion 42. Further, the inclined main body portion 44 is formed along a straight line inclined from an upper front side to a lower rear side. Accordingly, the main body portion 21 is formed so as to be bent in a substantially crank shape.

The attachment holding portion 45 protrudes upwards from the upper portion of the first main body portion 42, i.e., a position where the first main body portion 42 and the inclined main body portion 44 are continuous.

The dust collecting unit 22 communicates with the suction side of the electric blower 23. The dust collecting unit 22 collects dust suctioned by operation of the electric blower 23. The dust collecting unit 22 is, for example, a cyclone separation-type dust collecting cup which centrifugally separates (cyclonically separates) dust suctioned with air by the operation of the electric blower 23 from the air. Accordingly, the dust collecting unit 22 is an electrostatic source which generates static electricity due to friction generated between the dust collecting unit 22 and dust by driving of the electric blower 23. The dust collecting unit 22 is provided with a dust collecting locking portion 47 to lock the dust collecting unit 22 to the main body portion 21. In the embodiment, the dust collecting locking portion 47 is provided in an end portion of the dust collecting unit 22, for example. Alternatively, the dust collecting locking portion 47 may be provided on a side of the main body portion 21. In the embodiment, the dust collecting locking portion 47 is locked and held by the attachment holding portion 45. Further, the dust collecting unit 22 is provided with a dust collecting suction port (not illustrated) and a dust collecting exhaust port (not illustrated). The dust collecting suction port and the dust collecting exhaust port communicate with the first communication port and the second communication port in a state where the dust collecting unit 22 is attached to the main body portion 21. Accordingly, the dust collecting unit 22 communicates with the suction side of the electric blower 23 in a state where the dust collecting unit 22 is attached to the main body portion 21. The dust collecting unit 22 is connected to a downstream side of the main body connection port 26 (the air duct body 16) in a state where the dust collecting unit 22 is attached to the main body portion 21.

The electric blower 23 is provided with an electric motor and a fan which is rotated by the electric motor. A brushless motor is used as the electric motor, for example.

The control device 24 is a control board provided with a microcomputer, for example, etc. The control device 24 is provided with a drive control unit which operates the electric blower 23, for example, etc. in accordance with setting by a user using the setting button 28. The control device 24 may be provided with a charging circuit portion such as a constant current circuit which charges the secondary battery 25 by receiving electric power supply from an external power supply such as a commercial AC power supply.

The secondary battery 25 is a battery pack provided with batteries, for example.

The main body connection port 26 is an air suction port when the vacuum cleaner 11 is used as a handy cleaner. The main body connection port 26 is a communication port which allows the air duct body 16 and the cleaner main body 15 to communicate with each other when the vacuum cleaner 11 is used as a stick-type cleaner illustrated in FIG. 8.

The handle 27 illustrated in FIG. 6 holds at least the main body portion 21. In the embodiment, the handle 27 holds the cleaner main body 15 in one use state (FIG. 7) and holds the cleaner main body 15 and the air duct body 16 in another use state (FIG. 8). The handle 27 is a part which a user necessarily contacts when he uses the vacuum cleaner 11. The handle 27 is positioned in an upper portion of the cleaner main body 15 (the main body portion 21). The handle 27 is formed in an elongated shape in the forward-rearward direction and extends to the second main body portion 43 from the attachment holding portion 45. Further, the setting buttons 28 are disposed in an upper portion of the handle 27. An uneven slip resistance portion 49 for suppressing the slippage of the hand of a user gripping the handle 27 is provided in a lower portion of the handle 27. As illustrated in FIG. 2, the handle 27, in the embodiment, is provided with a handle main body portion 51 integrally provided on the side of the main body portion 21 and a handle cover 52 attached so as to cover the handle main body portion 51. The handle 27 is provided with through holes 53 as illustrated in FIG. 1. Further, the handle 27 is provided with a fixing portion 54 which positions the circuit board 29 and the conductive member 30. The handle 27 is provided with a board support portion 55 which supports the circuit board 29. Further, the handle 27 is provided with a positioning portion 56 (FIG. 2) which positions the conductive member 30. The handle 27 is provided with reinforcing ribs 57.

Figure 5:
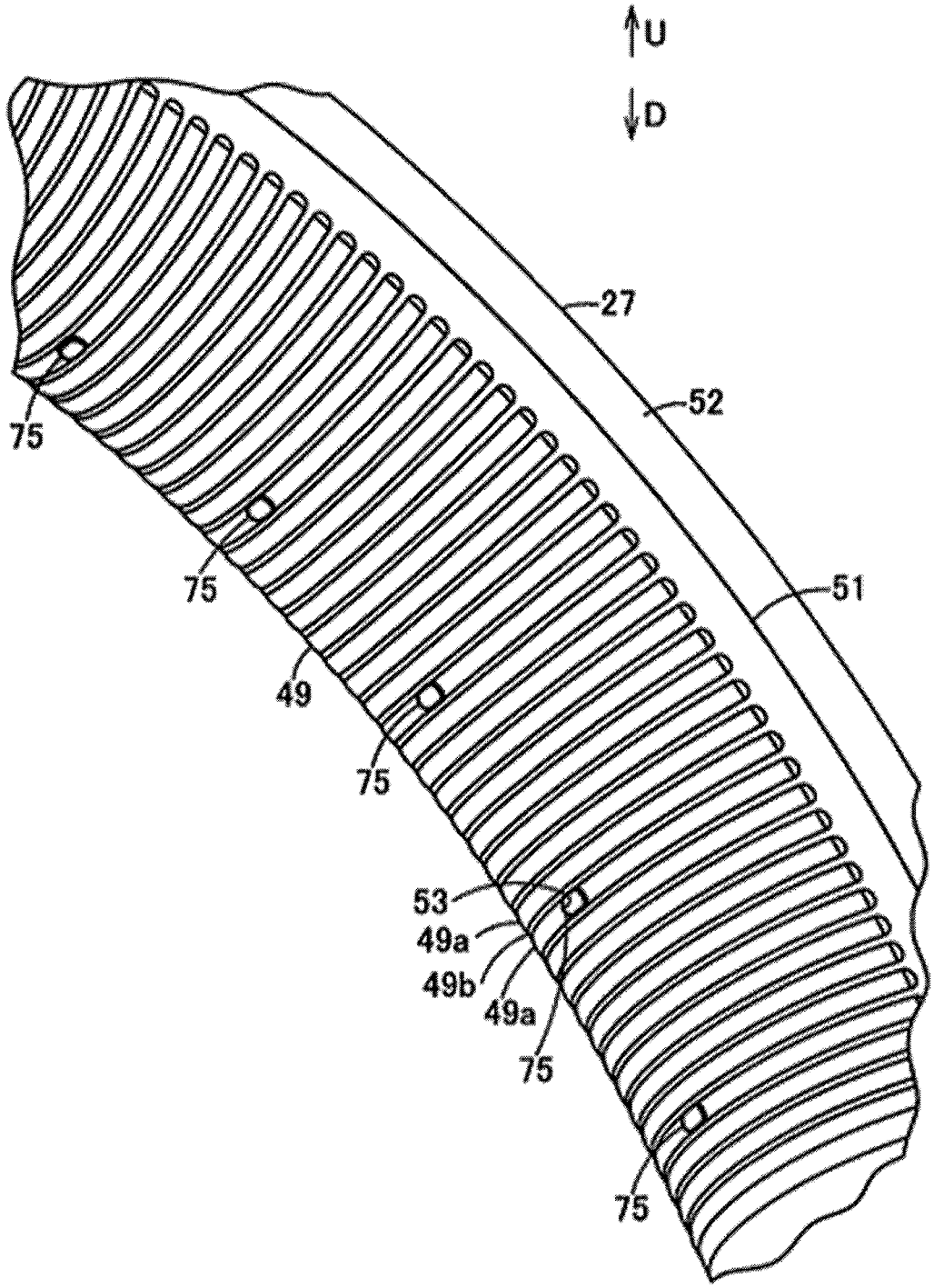
FIG. 5 is a perspective view illustrating a part of a handle of the vacuum cleaner.

The slip resistance portion 49 illustrated in FIGS. 1, 5 is provided along the leftward-rightward direction intersecting with (orthogonal to) the longitudinal direction of the handle 27. Accordingly, the slip resistance portion 49 applies resistance in the forward-rearward direction to the hand of a user who grips the handle 27, and suppresses slippage of the hand in the forward-rearward direction which is the longitudinal direction of the handle 27. The slip resistance portion 49 is disposed almost throughout the handle 27 from a front end side to a rear end side of the handle 27. The slip resistance portion 49 is positioned at least behind the setting buttons 28. The slip resistance portion 49 is provided with projecting portions 49*a* and recessed portions 49*b*, for example, alternately formed side by side. The slip resistance portion 49 is provided in the handle main body portion 51. In FIGS. 6 to 8 etc., the slip resistance portion 49 is illustrated with details omitted so that the description can be clarified.

The projecting portion 49*a* is formed in an arc shape with a cross section protruding downwards, for example. The projecting portions 49*a* are disposed at substantially equal intervals in the longitudinal direction of the handle 27.

The handle main body portion 51 illustrated in FIGS. 1, 2 constitutes the lower portion of the handle 27. The handle main body portion 51 is integrally provided with the attachment holding portion 45 and the second main body portion 43. The handle main body portion 51 has a closed loop shape. The handle main body portion 51 has an upper side open at a position of an upper portion extending to the second main body portion 43 from the attachment holding portion 45, i.e., an arcuate (arc-shaped) position.

The handle cover 52 constitutes the upper portion of the handle 27. The handle cover 52 is arcuately curved (in an arc shape). The handle cover 52 is configured to cover an open upper side of the handle main body portion 51. The handle cover 52 is provided with a fixing receiving portion 60 fixed and fastened with respect to the fixing portion 54 together by a fixing member 59 such as a screw. The handle cover 52 is configured to restrain the circuit board 29 and the conductive member 30 from above in a state where the handle cover 52 is fixed to the handle main body portion 51.

The through hole 53 exposes a part of the conductive member 30 to the outside of the handle 27. The through hole 53 is formed in a shape of a round hole having a small diameter, for example. The through hole 53 is provided at the lower portion of the handle 27. The through hole 53 is positioned in the slip resistance portion 49. In the embodiment, the through hole 53 is provided in the projecting portion 49*a* of the slip resistance portion 49. The through hole 53 is positioned in the bottom portion of the handle main body portion 51. Further, the through holes 53 are provided in the longitudinal direction of the handle 27. In the embodiment, the through holes 53 are disposed at substantially equal intervals in the forward-rearward direction. Accordingly, the through holes 53 are disposed at least in a region including the substantially middle portion of the handle 27 in the longitudinal direction. The through hole 53 is disposed at a center position of the handle 27 in the leftward-rightward direction (a width direction). Accordingly, the through hole 53 is disposed at a position where the handle 27 expands to a lowermost portion.

The fixing portion 54 is a boss for positioning the circuit board 29 and the conductive member 30 and for fixing and fastening the handle main body portion 51 and the handle cover 52 together by means of the fixing member 59. The fixing portion 54 is formed in a cylindrical shape and is disposed along the upward-downward direction. The fixing portion 54 is integrally provided in the handle main body portion 51. The tip side of the fixing portion 54 faces the upper side, i.e., the fixing receiving portion 60 of the handle cover 52. More specifically, the fixing portion 54 is positioned on a back surface side between the setting buttons 28.

The board support portion 55 is positioned to extend from the vicinity of the fixing portion 54 to a front of the fixing portion 54, for example. The board support portion 55 is formed in a rib shape along the leftward-rightward direction, for example, and has a function to reinforce the handle 27. The board support portion 55 is integrally provided at the handle main body portion 51.

The positioning portion 56 is formed in a rib shape along the forward-rearward direction at positions on both the left and right sides of the fixing portion 54. The positioning portion 56 is integrally provided at the handle main body portion 51.

Ribs 57 are provided along the leftward-rightward direction so as to connect positioning portion 56 and both side portions of the handle main body portion 51, for example. The ribs 57 is provided integrally with the handle main body portion 51. The ribs 57 are spaced apart from each other in the forward-rearward direction.

A user gripping the handle 27 can push the setting button 28 with the thumb of his hand gripping the handle 27, for example. The setting button 28 is provided at the handle cover 52.

Figure 4A:
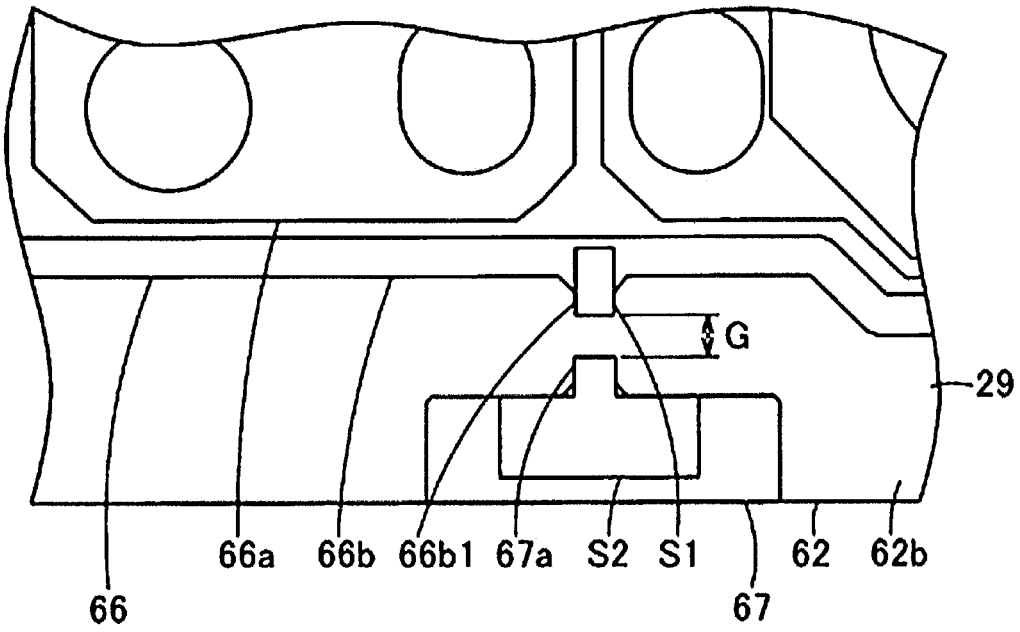
FIG. 4A is an enlarged plan view illustrating a part of a circuit board of the vacuum cleaner.
Figure 4B:
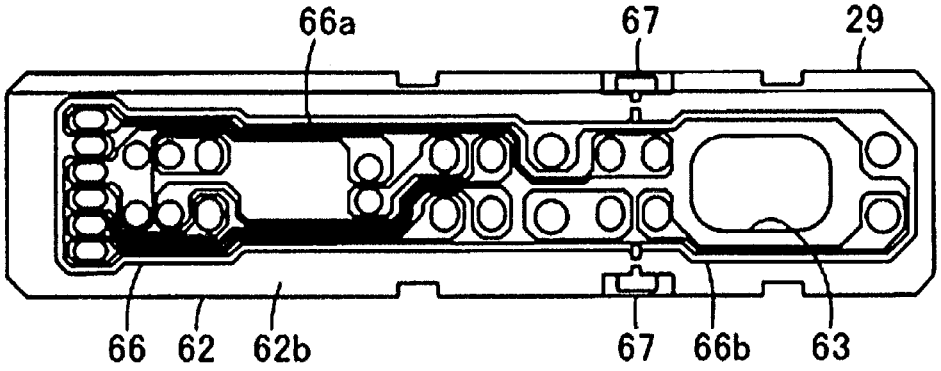
FIG. 4B is a plan view of the circuit board.

The circuit board 29 transmits a signal corresponding to the operation of the setting button 28 to the control device 24. The circuit board 29 is stored in the handle 27 i.e. between the handle main body portion 51 and the handle cover 52. The circuit board 29 is positioned in a lower portion on the back surface side of the setting button 28. Accordingly, the circuit board 29 is positioned near the front side of the handle 27. The circuit board 29 is provided with a plate-shaped board main body 62. Further, the circuit board 29 is provided with an opening 63. The circuit board 29 is provided with an element 64. Further, the circuit board 29 is provided with a connector 65. The circuit board 29 has a predetermined pattern 66 as illustrated in FIGS. 4A, 4B. The circuit board 29 also has a contact pattern 67.

The board main body 62 illustrated in FIGS. 1, 2 is formed of an insulating synthetic resin etc. In the embodiment, the board main body 62 is formed in a rectangular shape narrow in the leftward-rightward direction and long in the forward-rearward direction, for example.

The circuit board 29 is positioned with respect to the handle 27 (the handle main body portion 51) by the fixing portion 54 which is inserted through the opening 63. The opening 63 is provided so as to penetrate the board main body 62 in the thickness direction. In the embodiment, the opening 63 is disposed near a rear end as one end of the circuit board 29 (the board main body 62).

The element 64 constitutes a predetermined electric circuit on the circuit board 29. The element 64 is mounted on the board main body 62. In the embodiment, the element 64 is mounted on one main surface 62*a* which is the upper surface of the board main body 62. In the element 64 according to the embodiment, a switch 64*a* which is pushed and operated via the setting button 28, a resistor 64*b* as an impedance element and a lamp 64*c* such as an LED lamp as a display device (a display unit) for displaying the state of the vacuum cleaner 11 etc. are set, for example.

The connector 65 electrically connects the electric circuit composed of the element 64 and the control device 24 and the secondary battery 25. The connector 65 is mounted on the board main body 62. In the embodiment, the connector 65 is mounted on the one main surface 62*a* of the board main body 62. The connector 65 is disposed at a front end as the other end of the circuit board 29. In the embodiment, the connector 65 is disposed at the front end as the other end of the board main body 62. One end of a lead wire 68 is connected to the connector 65. The other end of the lead wire 68 is electrically connected to the control device 24 and the secondary battery 25 via the inner portion of the main body portion 21.

The lead wire 68 branches from the front end portion of the circuit board 29 to the control device 24 and the secondary battery 25 via the attachment holding portion 45 and the top of the electric blower 23. The lead wire 68 is disposed from the attachment holding portion 45 to the inclined main body portion 44 and the second main body portion 43.

The pattern 66 illustrated in FIG. 4B is formed in a thin film form on the board main body 62. The pattern 66 is formed of a conductive member such as copper. In the embodiment, the pattern 66 is formed on the other main surface 62*b* which is the lower surface (the back surface) of the board main body 62 facing the conductive member 30. The pattern 66 may have a voluntary shape, but in the embodiment conductive patterns 66*a* and a ground pattern 66*b* are formed.

The conductive pattern 66*a* is a conductive portion to constitute the electric circuit with the element 64 and the connector 65. The conductive pattern 66*a* is provided with a land electrically connected to the element 64 and the connector 65.

The ground pattern 66*b* sets the reference potential of the electric circuit formed on the circuit board 29. The ground pattern 66*b* is disposed in the vicinity of an outer edge portion of the circuit board 29, for example. In the embodiment, the ground pattern 66*b* is formed so as to surround the entire conductive pattern 66*a*. The ground pattern 66*b* is electrically connected (short-circuited) to the ground of the secondary battery 25. More specifically, the ground pattern 66*b* is electrically connected (short-circuited) to the ground of the secondary battery 25 along with the ground of the control device 24 via the lead wire 68 and has the same potential as the grounds. The ground pattern 66*b* has the same potential as the reference potential of the vacuum cleaner 11. In the ground pattern 66*b*, a conductive portion 66*b*1 is provided at a position facing the contact pattern 67 as illustrated in FIG. 4A. The pattern 66 has the conductive portion 66*b*1 at a position facing the contact pattern 67. The conductive portion 66*b*1 protrudes in the width direction of the pattern 66, for example. The conductive portion 66*b*1 protrudes from the pattern 66 toward the side of the circuit board 29. In the embodiment, the conductive portion 66*b*1 protrudes in the width direction of the ground pattern 66*b*. The conductive portion 66*b*1 protrudes from the ground pattern 66*b* toward the side of the circuit board 29. For example, solder S1 is applied to the conductive portion 66*b*1.

The contact pattern 67 illustrated in FIG. 4B is formed in a thin film shape on the board main body 62. The contact pattern 67 is formed of a conductive member such as copper. In the embodiment, the contact pattern 67 is formed on the other main surface 62*b* which is the lower surface (the back surface) of the board main body 62 facing the conductive member 30. The contact pattern 67 is formed on the same surface as the pattern 66. The contact pattern 67 is a static electricity receiving portion to receive static electricity generated by driving of the electric blower 23 (FIG. 6) via the pattern 66 and to discharge the static electricity via a user from the conductive member 30 (FIG. 1). The contact pattern 67 is mechanically and electrically connected (short-circuited) to the conductive member 30. In the embodiment, the contact pattern 67 is configured to receive the static electricity generated by driving of the electric blower 23 (FIG. 6) via the ground pattern 66*b*, for example. The contact pattern 67 receives the static electricity from the pattern 66 by dielectric breakdown of the air interposed between the contact pattern 67 and the pattern 66 due to a potential generated by the electric charge of the static electricity. The contact pattern 67 is disposed in the outer edge portions on both sides of the circuit board 29, for example. As illustrated in FIG. 4A, the contact pattern 67 faces the pattern 66 at a predetermined distance G. Specifically, in the embodiment, the contact pattern 67 is formed in a projecting shape provided with a facing conductive portion 67*a* facing the conductive portion 66*b*1 of the ground pattern 66*b*. For example, solder S2 is applied to the contact pattern 67 to include the place of the facing conductive portion 67*a*.

When contact is made between the pattern 66 and the contact pattern 67 i.e. between the conductive portion 66*b*1 and the facing conductive portion 67*a* in the embodiment, the same potential as the pattern 66 (a reference potential in the embodiment) is caused to be generated in the contact pattern 67 even at the time at which the vacuum cleaner 11 (FIG. 6) is not used. When an excessive distance is made between the pattern 66 and the contact pattern 67, the potential due to the electric charge of the static electricity, which is accumulated until breakdown of insulation by air between the pattern 66 and the contact pattern 67, becomes high. Accordingly, it is preferable that an appropriate predetermined distance G (for example, approximately 0.6 mm) is provided. Thus, the contact pattern 67 is disposed in proximity to the pattern 66.

Figure 3A:
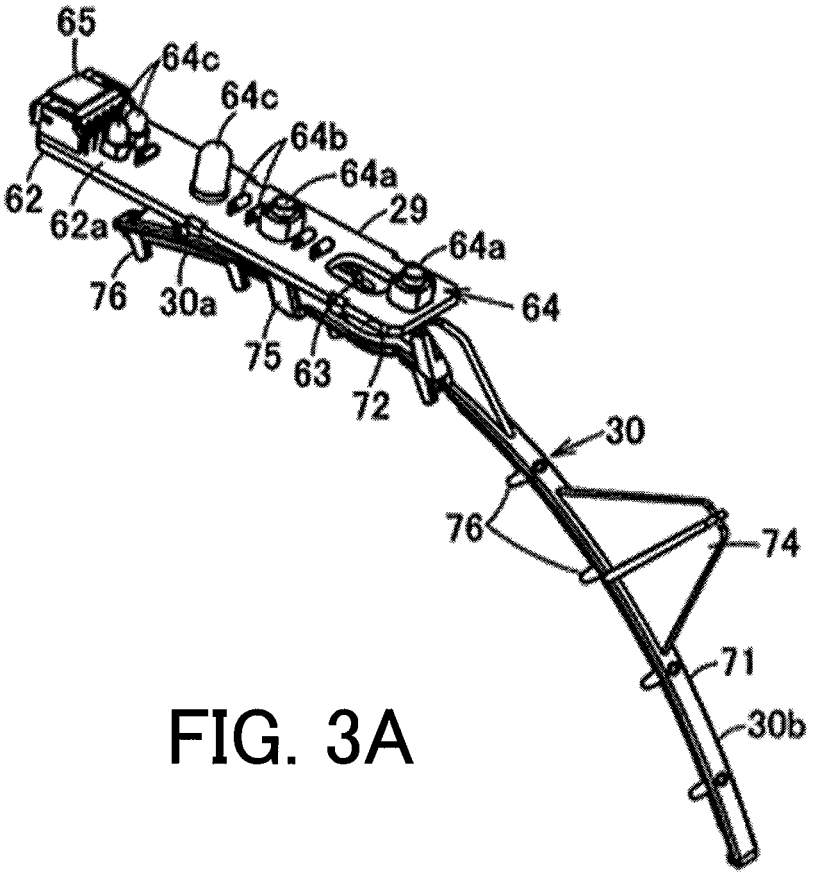
FIG. 3A is a perspective view illustrating a part of the vacuum cleaner from above.
Figure 3B:
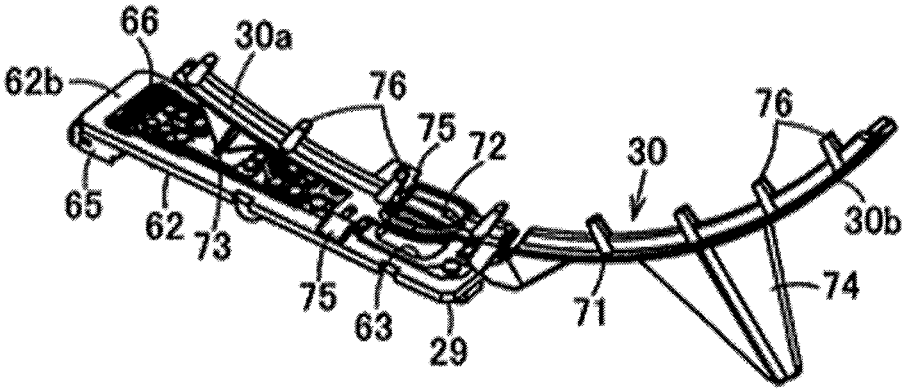
FIG. 3B is a perspective view illustrating a part of the vacuum cleaner from below.

The conductive member 30 illustrated in FIG. 1 transfers the static electricity received from the pattern 66 (FIG. 4A) to a user. In the embodiment, the conductive member 30 is disposed so as to be in contact with the contact pattern 67 (FIG. 4B). The conductive member 30 is formed of a member containing a carbon member such as conductive particles. A synthetic resin is preferably used as the member. Polypropylene or ABS is more preferably used as the member. The conductive member 30 is formed in an elongated shape along the longitudinal direction of the handle 27 i.e. along the forward-rearward direction. Further, the conductive member 30 is provided with a conductive member main body 71 as illustrated in FIGS. 3A and 3B. The conductive member 30 is provided with an opening portion 72. Further, the conductive member 30 is provided with support portions 73 which supports the circuit board 29. The conductive member 30 is provided with a cover support portion 74 which supports the handle cover 52 (FIG. 1). Further, the conductive member 30 is provided with a contact portion 75, which is in contact with the contact pattern 67 (FIG. 4A) of the circuit board 29. The conductive member 30 is provided with projection portions 76 as transmission portions exposed to the outside of the handle 27 (FIG. 1). In the embodiment, the conductive member 30 is divided in the forward-rearward direction into one conductive member 30*a* and the other conductive member 30*b*. The one conductive member 30*a* is positioned below the circuit board 29. The one conductive member 30*a* is positioned between the circuit board 29 and the bottom portion of the handle main body portion 51 as illustrated in FIG. 1. The other conductive member 30*b* is electrically connected (short-circuited) to the rear end portion of the one conductive member 30*a* with the front end portion of the other conductive member 30*b* in contact (pressure contact) with the rear end portion of the one conductive member 30*a*. Further, the other conductive member 30*b* is positioned behind the circuit board 29.

The conductive member main body 71 illustrated in FIGS. 1 to 3 is formed in an elongated shape with a predetermined width. The conductive member main body 71 is formed in an elongated shape along the handle 27. The conductive member main body 71 is arcuately curved along the curvature of the handle 27.

The conductive member 30 is positioned with respect to the handle 27 by that the fixing portion 54 is inserted through the opening portion 72 and the opening 63 of the circuit board 29. The opening portion 72 positions the conductive member 30 with respect to the handle main body portion 51. The opening portion 72 is provided so as to penetrate the conductive member main body 71 in the thickness direction. In the embodiment, the opening portion 72 is disposed near the front side of the conductive member 30. The opening portion 72 is disposed near the front side of the conductive member main body 71. Specifically, the opening portion 72 is disposed near the rear end of the one conductive member 30*a*.

The support portions 73 protrude in a rib shape upwards from the conductive member 30. Specifically, the support portions 73 protrude in a rib shape upwards from the conductive member main body 71. In the embodiment, a plurality of the support portions 73 are provided. Specifically, the support portions 73 are disposed in the front end portion of the conductive member 30 and the substantially middle portion of the conductive member 30 in the longitudinal direction of the conductive member 30. More specifically, the support portions 73 are disposed in the front end portion of the one conductive member 30*a* and the front end portion of the other conductive member 30*b*. The support portions 73 are disposed in front of and behind the fixing portion 54. Accordingly, the front end portion and the rear end portion of the circuit board 29 are supported from below by the support portions 73. In the drawings, the reference numeral is given only to the support portion 73 in the front end portion of the one conductive member 30*a*.

The cover support portion 74 protrudes in a rib shape upwards from the conductive member 30. Specifically, the cover support portion 74 protrudes toward the handle cover 52 from the conductive member main body 71. In the embodiment, the cover support portion 74 is disposed behind the support portion 73. More specifically, the cover support portion 74 is disposed in the substantially middle portion of the other conductive member 30*b* in the longitudinal direction of the other conductive member 30*b*.

The contact portion 75 is a part which is electrically connected (short-circuited) to the contact pattern 67 by being brought into pressure contact with the contact pattern 67 (FIG. 4A) of the circuit board 29. The contact portion 75 protrudes in a rib shape toward the circuit board 29 from both sides of the conductive member 30, for example. The contact portion 75 is positioned on both sides of the conductive member main body 71. For example, the contact portion 75 is positioned closer to the front end side than the opening portion 72. The contact portion 75 has a flat tip portion in pressure contact with the solder S2 (FIG. 4A) of the contact pattern 67.

The projection portion 76 is a part having a tip side which is exposed to the lower portion (the slip resistance portion 49) of the handle 27 by that the projection portion 76 is inserted into the through hole 53. The projection portion 76 protrudes in a columnar shape downwards from the conductive member 30. Specifically, the projection portion 76 protrudes from the conductive member main body 71 toward the handle main body portion 51. In the embodiment, the projection portions 76 are disposed on the conductive member 30. The projection portions 76 are disposed on the conductive member main body 71. More specifically, the projection portions 76 are disposed at substantially equal intervals between both longitudinal ends of the conductive member 30. Accordingly, in the conductive member 30, the projection portions 76 are disposed at least in a region including the substantially middle portion of the handle 27 in the longitudinal direction. More specifically, in the conductive member 30, the projection portions 76 are disposed at longitudinal positions of the handle 27. The projection portion is disposed at the center position of the handle 27 in the leftward-rightward direction (the width direction). Accordingly, the projection portion 76 is disposed at a position expanding to the lowermost portion of the handle 27. As illustrated in FIG. 5, the tip portion of the projection portion 76 inserted into the through hole 53 is substantially flush with the projecting portion 49*a* of the slip resistance portion 49. The projection portion 76 is a part of the conductive member 30. The projection portion 76 is a conductive material.

In the vacuum cleaner of the embodiment, the first communication port is positioned in the upper portion of the first main body portion 42. Similarly, the second communication port is positioned in the upper portion of the first main body portion 42. Accordingly, the first communication port and the second communication port are positioned in the upper portion of the cleaner main body 15 (the main body portion 21). The first communication port and the second communication port communicate with each other via the dust collecting unit 22 in a state where the dust collecting unit 22 is attached to the main body portion 21.

The exhaust port 33 is the downstream end part of an exhaust air duct. The exhaust port 33 is positioned in both side portions of the first main body portion 42. Accordingly, the exhaust port 33 is disposed near the front side of the cleaner main body 15. The exhaust port 33 may be covered with a filter (not illustrated).

An air duct is partitioned in the air duct body 16 illustrated in FIG. 8, and communicates with the suction side of the electric blower 23 in a state where the air duct is connected to the cleaner main body 15. The air duct body 16 is provided with an elongated extension pipe 81. A suction port body may be provided on the tip side (the upstream side) of the air duct body 16. Any suction port body can be used as the suction port body. In the embodiment, a floor brush 82 is used as an example of the suction port body. The air duct body 16 is an electrostatic source which generates static electricity due to friction generated between the air duct body 16 and dust by driving of the electric blower 23. The air duct body 16 is an optional configuration.

The extension pipe 81 is airtightly connected to the dust collecting unit 22 with the base end side of the extension pipe 81 connected to the cleaner main body 15. For example, the base end side of the extension pipe 81 is connected to the main body connection port 26. The extension pipe 81 is detachably held by a clamp 84 provided in the cleaner main body 15 (the main body portion 21).

The floor brush 82 is provided with a case body 86. The floor brush 82 is provided with a connecting pipe 87. The case body 86 is laterally long. The case body 86 is formed in an elongated shape in the leftward-rightward direction. A suction port (not illustrated) is open in the lower portion of the case body 86 which faces a surface to be cleaned. The connecting pipe 87 is rotatably connected to the case body 86. Further, the connecting pipe 87 communicates with the suction port and is airtightly connected to the tip side of the extension pipe 81. The floor brush 82 is connected to the tip side of the extension pipe 81. For example, the connecting pipe 87 is inserted into and connected to the extension pipe 81 in the floor brush 82. In the floor brush 82, connection of the extension pipe 81 is retained by a floor brush clamp 89 provided in the extension pipe 81.

A working of the first embodiment will be described below.

In a case where the vacuum cleaner 11 is used as a handy suction cleaner (one use state (FIG. 7)), only the cleaner main body 15, in which the dust collecting unit 22 is mounted on the main body portion 21, is used. The vacuum cleaner 11 is used in a state where the air duct body 16 is removed from the cleaner main body 15. In this case, an air duct body shorter than and different from the air duct body 16 provided with the extension pipe 81, the floor brush 82 etc. may be connected to the main body connection port 26. Examples of the air duct body include a clearance nozzle (a crevice nozzle).

In the vacuum cleaner 11, the control device 24 drives the electric blower 23 in accordance with the operation set by that a user gripping the handle 27 operates the setting button 28. Dust on a surface to be cleaned is suctioned with air by means of the negative pressure resulting from the driving of the electric blower 23 while the main body connection port 26 facing the surface to be cleaned or the air duct body 16 connected to the main body connection port 26 is moved in the forward-rearward direction or an oblique direction on the surface to be cleaned.

Schematically, the dust-containing air is suctioned into the dust collecting unit 22 from the main body connection port 26 and the dust is separated and collected from the air. The dust-separated air is discharged from the exhaust port 33 to the outside of the cleaner main body 15 via the exhaust air duct after the dust-separated air is suctioned into the electric blower 23.

In a case where the vacuum cleaner 11 is used as a stick-type suction cleaner (another use state (FIG. 8)), the air duct body 16 is connected to the cleaner main body 15 in which the dust collecting unit 22 is mounted on the main body portion 21. In this state, the floor brush 82 communicates with the suction side of the electric blower 23 (via the dust collecting exhaust port of the dust collecting unit 22 and the second communication port of the cleaner main body 15 and communicates with the dust collecting unit 22 via the extension pipe 81, the main body connection port 26 of the cleaner main body 15, the first communication port, and the dust collecting suction port).

In the vacuum cleaner 11, dust on the surface to be cleaned is suctioned together with air from the suction port of the floor brush 82 by means of the negative pressure generated by driving of the electric blower 23, while the floor brush 82 is placed on the surface to be cleaned by a user gripping the handle 27, the control device 24 drives the electric blower 23 in accordance with performance set by operating the setting button 28 of the handle 27 and the floor brush 82 alternately travels in the forward-rearward direction, an oblique direction etc. on the surface to be cleaned.

The suctioned dust-containing air is moved from the floor brush 82 to the cleaner main body 15 (the main body portion 21) via the extension pipe 81. Then, the dust is separated from the air and collected in the dust collecting unit 22 as in the case of the one use state described above.

Static electricity is generated due to friction with dust at least in the dust collecting unit 22 by the electric blower 23 being driven, i.e., by the vacuum cleaner 11 being started. In the embodiment, static electricity is generated mainly in the dust collecting unit 22 in one use state and static electricity is generated mainly in the dust collecting unit 22 and the air duct body 16 in another use state. The electric charge of the static electricity flows to a part with a lower potential through a conductive part allowing an electric current to flow with ease, such as the pattern 66 of the circuit board 29, or a screw as a metallic member for assembly etc. disposed in each portion of the cleaner main body 15 or a plated synthetic resin and accumulates such that the same potential is given as a whole. Subsequently, when the potential reaches a degree allowing the dielectric breakdown of the air interposed between the conductive part such as the pattern 66 and the contact pattern 67 positioned at the predetermined distance G (in proximity), the static electricity is moved to the contact pattern 67, the static electricity is discharged to the hand of a user gripping the handle 27 from the projection portion 76 of the conductive member 30 in contact with the contact pattern 67, the static electricity is discharged to the ground through the user's body, and the potential is lowered.

Once the cleaning is completed, the user stops the electric blower 23 with the control device 24 by operating the setting button 28.

As described above, according to the first embodiment, a part of the conductive member 30 (the projection portion 76) conducting the static electricity generated due to operation of the electric blower 23 is disposed in the handle 27, which a user contacts (grips) in using the vacuum cleaner 11. As a result, when the electric blower 23 is driven (during the operation of the vacuum cleaner 11), static electricity can be micro-discharged to the user in contact with the handle 27 via a part of the conductive member 30 (the projection portion 76). Accordingly, it is possible to effectively release static electricity even with the cordless and non-wired configuration using the secondary battery 25.

Especially, a part of the conductive member 30 (the projection portion 76) is disposed in the handle 27 holding the main body portion 21, and thus a user can easily remain in contact with the conductive member 30 almost at all times in using the vacuum cleaner 11 and the static electricity can be effectively released.

In the vacuum cleaner 11, static electricity is generated due to friction between the dust suctioned by the operation of the electric blower 23 and the dust collecting unit 22, the air duct body 16 etc., and thus the electric charge of the static electricity begins to accumulate immediately after the vacuum cleaner 11 is started and basically static electricity is difficult to be generated while the vacuum cleaner 11 remains stopped. In the embodiment, the handle 27 remains gripped by a user until cleaning is completed and the vacuum cleaner 11 is stopped after the vacuum cleaner 11 is started, and thus the user remains in contact with the handle 27 always from a timing when the electric charge of the static electricity begins to accumulate, i.e., from a point in time when the potential of the static electricity is low. Accordingly, the static electricity is continuously micro-discharged and actively released before a spark phenomenon occurs due to an increase in electrostatic potential, and thus the user does not have to undergo any unpleasant electric shock due to an accumulated electrostatic charge.

Especially, in the case of cyclone separation where the dust collecting unit 22 performs high-speed centrifugal separation on dust, static electricity is easy to be generated in the dust collecting unit 22. Accordingly, by adopting the above-described configuration in the vacuum cleaner 11 provided with the cyclone separation-type dust collecting unit 22, it is possible to effectively release the static electricity generated in the cyclone separation-type dust collecting unit 22 before high-potential accumulation in driving the electric blower 23.

At least a part of the conductive member 30 (the projection portion 76) is disposed in the lower portion of the handle 27, and thus at least a part of the conductive member 30 can be effectively disposed at a position easy to come into contact with the hand of a user gripping the handle 27.

Specifically, by at least a part of the conductive member 30 (the projection portion 76) being disposed so as to be substantially flush with the projecting portion 49*a* of the uneven slip resistance portion 49 in the lower portion of the handle 27, at least a part of the conductive member 30 (the projection portion 76) can be disposed at the position easy to come into contact with the hand of the user gripping the handle 27 and the static electricity can be reliably micro-discharged during the driving the electric blower 23 with respect to the user gripping the handle 27.

The conductive member 30 (the contact portion 75) is disposed so as to be in contact with the contact pattern 67 disposed at the predetermined distance G from the predetermined pattern 66 (the ground pattern 66*b* in the embodiment) of the circuit board 29. Accordingly, the conductive member 30 does not immediately reach the same potential as the pattern 66. As a result, even in a case where a user touches the conductive member 30 on a normal occasion (when the vacuum cleaner 11 is not used) etc., the user does not have to undergo any unpleasant electric shock due to the potential difference between the potential of the pattern 66 (the potential (the reference potential) of the ground pattern 66*b* in the embodiment) and the ground potential (the earth potential).

In addition, the electric charge of the static electricity can be delivered to the conductive member 30 by means of the pattern 66 pre-provided on the circuit board 29, and thus it is possible to easily form a configuration for electrostatic charge delivery.

The conductive member 30 is a member containing a carbon member, and thus it is possible to easily form the conductive member 30 in a shape corresponding to the grounding portion of the conductive member 30 such as the handle 27 and it is possible to achieve a lightweight design.

At least a part of the conductive member 30 (the projection portion 76) is provided at longitudinal positions of the handle 27, and thus contact can be facilitated with respect to the conductive member 30 regardless of which position of the handle 27 is gripped by a user.

At least a part of the conductive member 30 (the projection portion 76) is provided in the substantially middle portion of the handle 27 in the longitudinal direction of the handle 27, which is normally gripped by a user, and thus contact is further facilitated between the user gripping the handle 27 and the conductive member 30.

A second embodiment will be described with reference to FIG. 9. The same reference numerals will be given to configurations and operations similar to those of the first embodiment, and description thereof will be omitted.

Figure 9A:
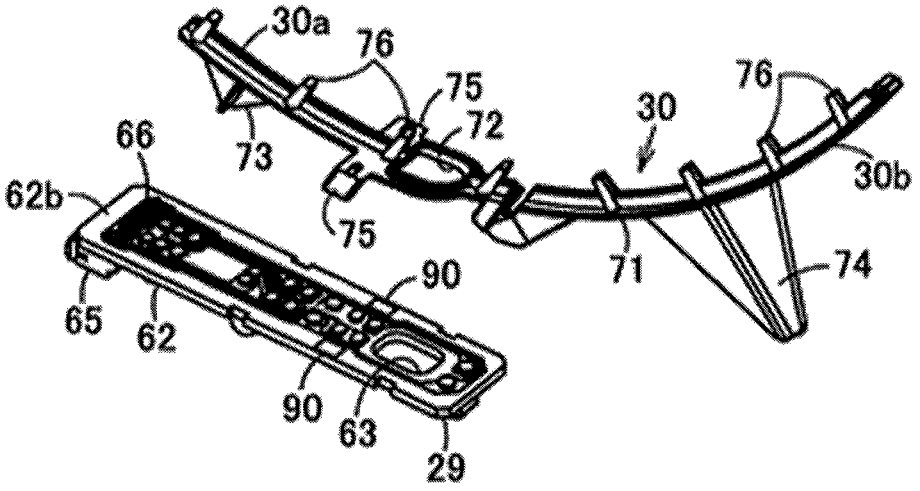
FIG. 9A is a perspective view illustrating a part of a vacuum cleaner as electrical equipment according to a second embodiment.
Figure 9B:
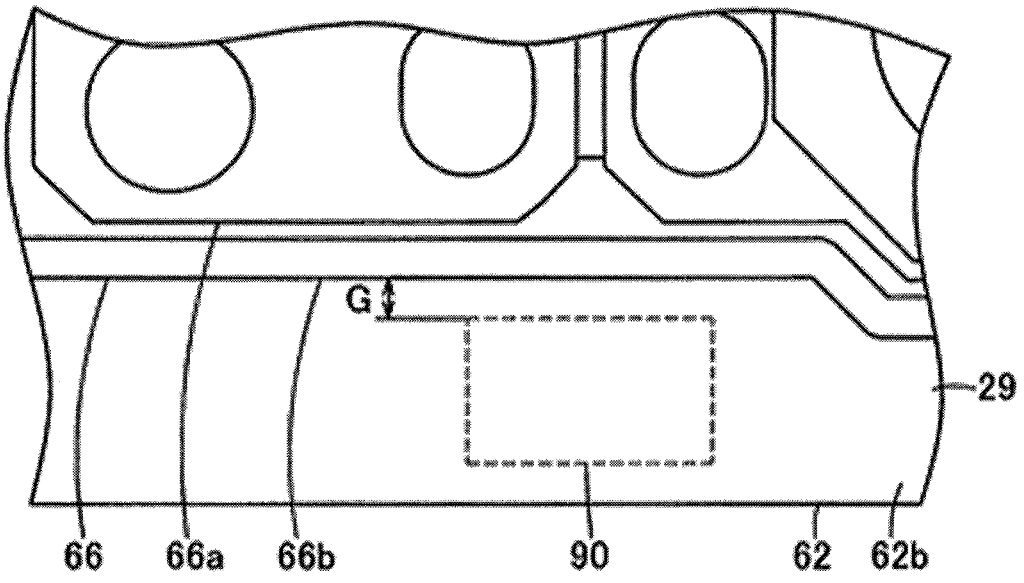
FIG. 9B is an enlarged plan view illustrating a part of a circuit board of the vacuum cleaner.

In the second embodiment, the circuit board 29 of the first embodiment is not provided with the contact pattern 67 and the conductive member 30 (the contact portion 75) is disposed so as to face the pattern 66 at the predetermined distance G as illustrated in FIGS. 9A and 9B. In the embodiment, the conductive member 30 (the contact portion 75) is disposed so as to face the ground pattern 66*b* at the predetermined distance G.

The contact portion 75 of the conductive member 30 is disposed so as to be in direct contact with a contact position 90 of the other main surface 62*b* of the board main body 62 at a position at the predetermined distance G from the pattern 66 of the circuit board 29.

In this configuration, the electric charge of the static electricity generated by driving of the electric blower 23 (by the vacuum cleaner 11 being started) flows to a part with a lower potential through a conductive part which allows an electric current to flow with ease, such as a plated synthetic resin, a metallic screw or the pattern 66 of the circuit board 29, and accumulates such that the same potential is given as a whole. Subsequently, when the potential reaches a degree which allows the dielectric breakdown of the air interposed between the conductive part such as the pattern 66 (the ground pattern 66*b* in the embodiment) and the conductive member 30 (the contact portion 75) positioned at the predetermined distance G (in proximity), the electric charge of the static electricity is moved to the conductive member 30 (the contact portion 75), the static electricity is discharged to the hand of a user gripping the handle 27 from the projection portion 76 of the conductive member 30, the static electricity is discharged to the ground through the user's body, and the potential is lowered.

The conductive member 30 (the contact portion 75) is disposed at the predetermined distance G from the predetermined pattern 66 (the ground pattern 66*b* in the embodiment) of the circuit board 29, and thus the conductive member 30 does not immediately reach the same potential as the pattern 66. As a result, even in a case where a user touches the conductive member 30 on a normal occasion (when the vacuum cleaner 11 is not used) etc., the user does not have to undergo any unpleasant electric shock due to the potential difference between the potential of the pattern 66 (the potential (the reference potential) of the ground pattern 66*b* in the embodiment) and the ground potential (the earth potential).

Figure 10:
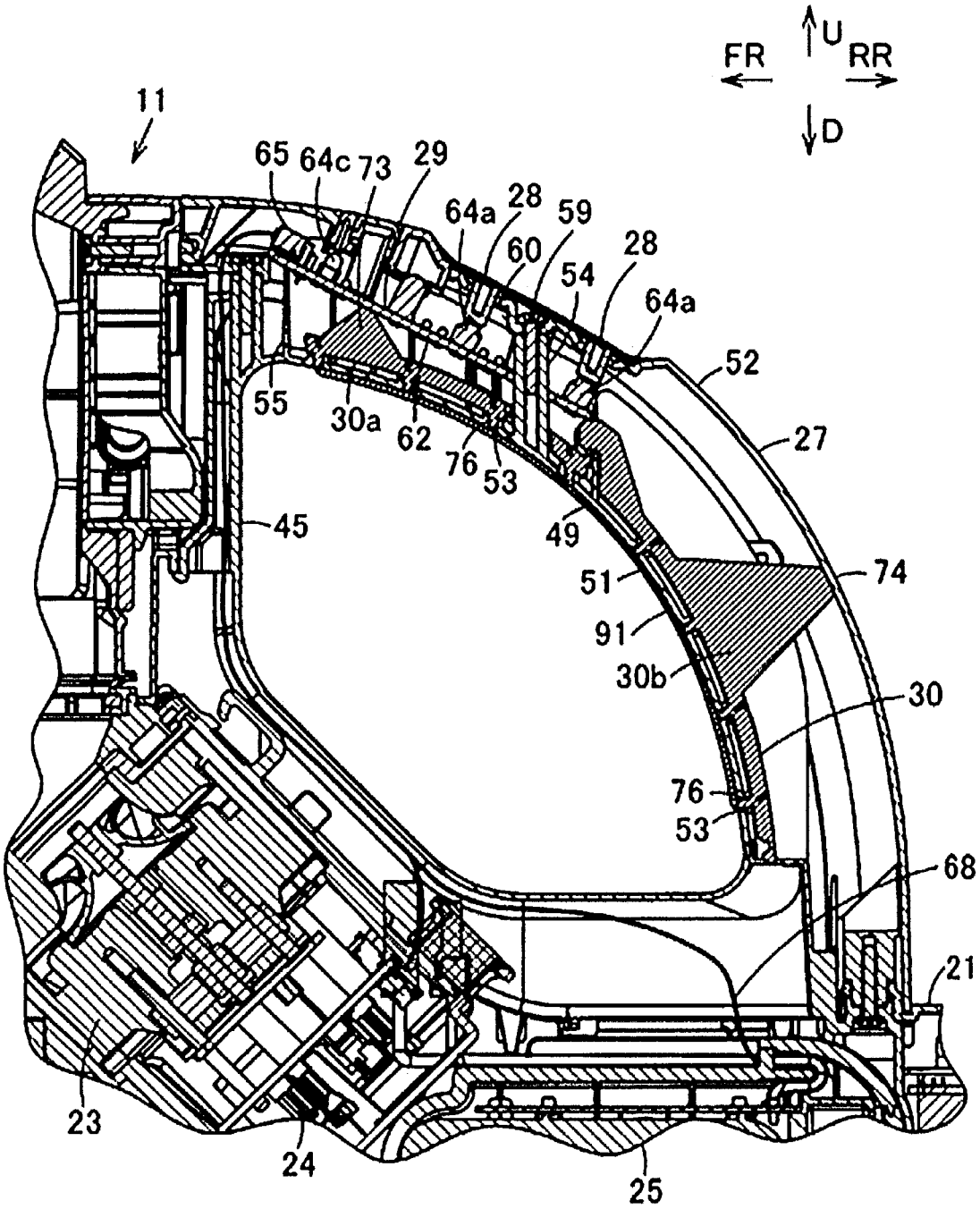
FIG. 10 is a cross-sectional view illustrating a part of a vacuum cleaner as electrical equipment according to a third embodiment.

A third embodiment will be described with reference to FIG. 10. The same reference numerals will be given to configurations and operations similar to those of each embodiment described above, and description thereof will be omitted.

The third embodiment further includes a sheet 91 as a conductive member. The sheet 91 is provided so as to cover the lower portion of the handle 27. The sheet 91 is provided on the outer surface of the handle 27. The sheet 91 is a soft member such as an elastomer or rubber having electrical conductivity, for example. Further, the sheet 91 is electrically connected (short-circuited) in contact with the projection portion 76 of the conductive member 30 exposed in the lower portion of the handle 27.

When the vacuum cleaner 11 is used, the control device 24 drives the electric blower 23 in accordance with the operation set by that the user gripping the handle 27 operate the setting button 28. As a result, dust on a surface to be cleaned is suctioned with air by means of the negative pressure generated by driving of the electric blower 23 and cleaning is performed.

Although static electricity is generated at this time by driving of the electric blower 23, i.e., by the vacuum cleaner 11 being started, the lower portion of the handle 27 is covered with the conductive sheet 91 in the embodiment, and thus the electric charge of the static electricity moved to the conductive member 30 via the pattern 66 is discharged from the projection portion 76 via the sheet 91 to the hand of the user gripping the handle 27 and discharged to the ground through the user's body.

By provided the sheet 91 as a conductive soft member as described above at the handle 27, it is possible to suppress the slippage of the hand of the user gripping the handle 27 by means of the sheet 91 and contact between the user's hand and the conductive member 30 can be ensured with reliability. As a result, the static electricity can be reliably micro-discharged during the driving the electric blower 23 with respect to the user gripping the handle 27.

Figure 11:
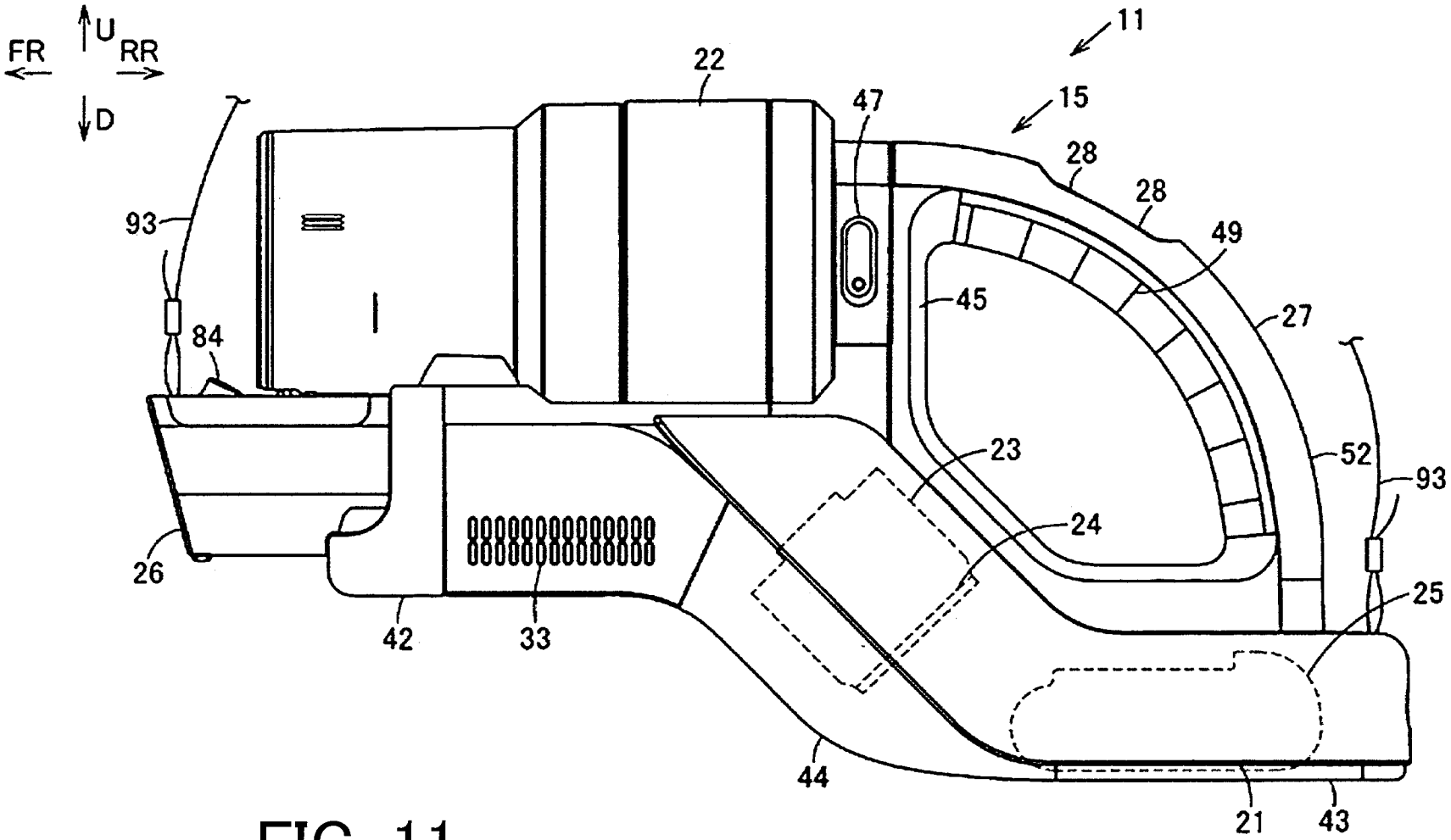
FIG. 11 is a side view illustrating a part of a vacuum cleaner as electrical equipment according to a fourth embodiment.

A fourth embodiment will be described with reference to FIG. 11. The same reference numerals will be given to configurations and operations similar to those of each of the above embodiments, and description thereof will be omitted.

The fourth embodiment is provided with a belt (a shoulder belt) 93, which is a main body holding portion as a human body contacting portion. The belt 93 is to hold the main body portion 21 by shouldering etc. In the embodiment, the belt 93 is to hold the cleaner main body 15. In a case where the vacuum cleaner 11 is used in a state where the vacuum cleaner 11 is shouldered by means of the belt 93, it is preferable in the interest of convenience to connect a flexible air duct body, such as a hose body different from the air duct body 16, to the main body connection port 26. The belt 93 has a loop shape with both ends connected to different places of the main body portion 21, for example. In the embodiment, both ends of the belt 93 are connected to the front end portion of the first main body portion 42 and the rear end portion of the second main body portion 43, for example. Further, the belt 93 is formed of a conductive member, for example. The belt 93 has an elongated shape. Accordingly, in FIG. 11, only both end portions connected to the cleaner main body 15 (the main body portion 21) are illustrated and the intermediate portion of the belt 93 is not illustrated.

The vacuum cleaner 11 can be used once the middle portion between both ends of the belt 93 is hung on a user's shoulder etc. Although the electric charge of static electricity accumulated by driving of the electric blower 23 is transferred to a plated synthetic resin, a metallic screw or the circuit board 29 etc., but the belt 93 holding the main body portion 21 is composed of a conductive member in the embodiment so that the static electricity is discharged from the belt 93 to the user's shoulder and discharged to the ground through the user's body.

By a conductive member constituting the belt 93 holding the main body portion 21, a user can easily remain in contact with the conductive member almost always during the use of the vacuum cleaner 11 and it is possible to effectively release static electricity. The belt 93 may be electrically connected to the contact pattern 67 or the conductive member 30. The belt 93 may electrically float.

In the case of the fourth embodiment, the handle 27 may not be provided with the conductive member 30.

Figure 12:
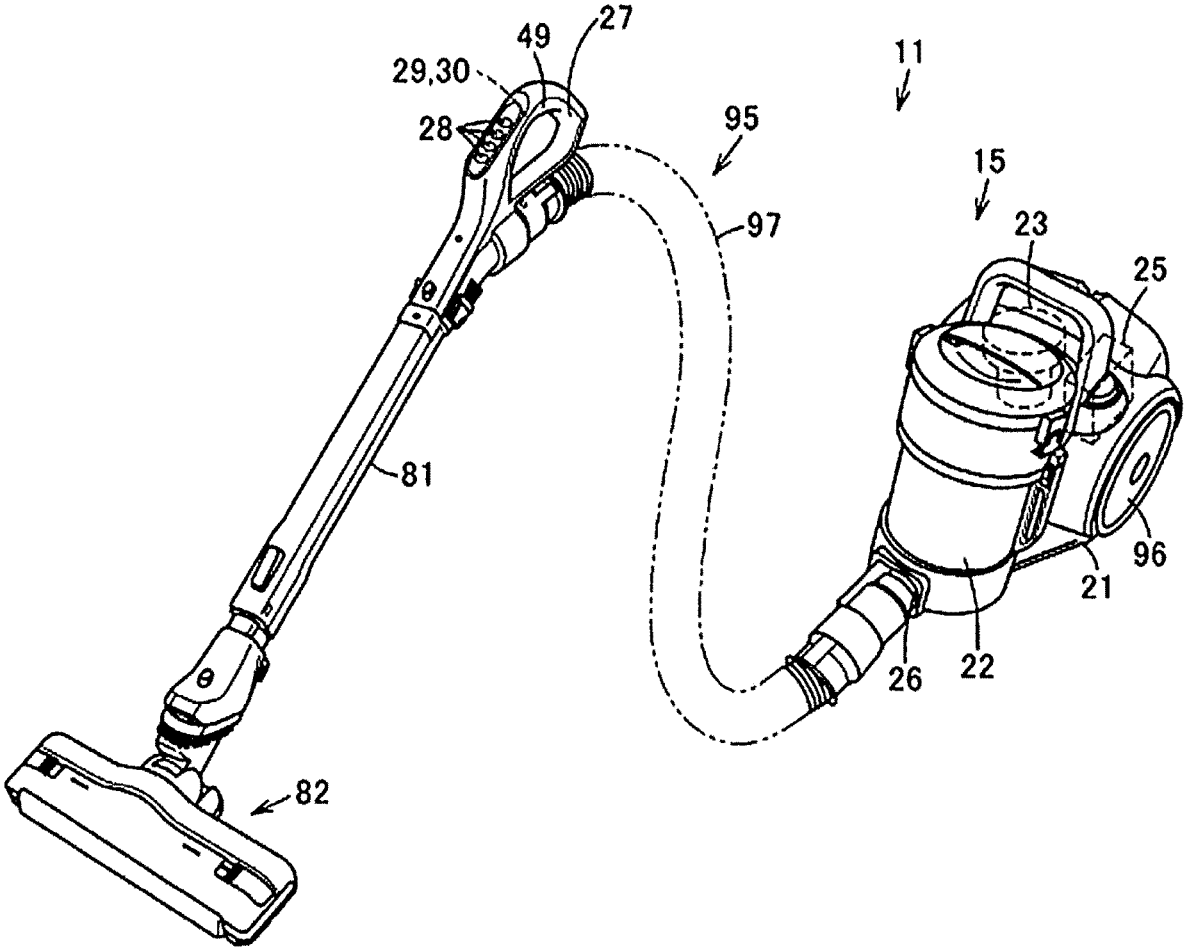
FIG. 12 is a perspective view illustrating a vacuum cleaner as electrical equipment according to a fifth embodiment.

A fifth embodiment will be described with reference to FIG. 12. The same reference numerals will be given to configurations and operations similar to those of each of the above embodiments, and description thereof will be omitted.

In the fifth embodiment, the vacuum cleaner 11 is a so-called canister-type cordless suction cleaner which is provided with the cleaner main body 15 capable of traveling on a surface to be cleaned (a floor surface) and an air duct body 95 as a connecting portion connected to the main body portion 21 of the cleaner main body 15.

The cleaner main body 15 may be provided with traveling wheels 96 which allows traveling on a surface to be cleaned (a floor surface), for example. The traveling wheels 96 are provided on both sides of the main body portion 21, for example.

An air duct is partitioned in the air duct body 95. The air duct body 95 communicates with the suction side of the electric blower 23 in a state of being connected to the cleaner main body 15. The air duct body 95 is provided with a hose body 97. The air duct body 95 is provided with the extension pipe 81 connected to the tip side (the upstream side) of the hose body 97. A suction port body may be provided on the tip side (the upstream side) of the air duct body 16. Any suction port body can be used as the suction port body. In the embodiment, the floor brush 82 is used as an example of the suction port body. Further, the air duct body 16 is provided with the handle 27, which is a connecting gripping portion as a human body contacting portion to grip the air duct body 16. The air duct body 95 is an electrostatic source which generates static electricity due to the friction generated between the air duct body 95 and dust by driving of the electric blower 23.

The handle 27 is provided on the tip side of a hose body 37, for example. The handle 27 is provided with the slip resistance portion 49. The internal structure of the handle 27 is the same as those of the first to third embodiments.

In the vacuum cleaner 11, dust on the surface to be cleaned is suctioned with air from the suction port of the floor brush 82 by means of the negative pressure generated by driving of the electric blower 23, while the cleaner main body 15 is made travel to an appropriate position on a surface to be cleaned, the floor brush 82 is placed on the surface to be cleaned by a user gripping the handle 27, the control device 24 drives the electric blower 23 in accordance with the operation set by that the setting button 28 of the handle 27 is operated, and the floor brush 82 alternately travels in the forward-rearward direction, an oblique direction etc. on the surface to be cleaned. The subsequent operation is the same as those of the first to third embodiments.

Also in this case, static electricity can be micro-discharged via the conductive member 30 to the user in contact with the handle 27 when the electric blower 23 is driven (during the operation of the vacuum cleaner 11), by that the conductive member 30 which conducts the static electricity generated due to operation of the electric blower 23 is disposed in the handle 27 that the user contacts (grips) during the use of the vacuum cleaner 11. Accordingly, it is possible to effectively release static electricity even with the cordless and non-wired configuration using the secondary battery 25.

Especially, the conductive member 30 is disposed in the handle 27 holding the air duct body 95, and thus a user can easily remain in contact with the conductive member 30 almost always during the use of the vacuum cleaner 11 and the static electricity can be effectively released.

In each of the embodiments described above, the conductive member may be a member obtained by plating a surface of a synthetic resin base material, for example.

Further, the conductive member may be a low-resistance body insofar as the conductive member is capable of transferring static electricity.

The conductive member can also be flush with a position of the handle 27 other than the slip resistance portion 49.

Further, the handle 27 itself may be formed by means of a conductive member.

The same function and effect can be achieved even when the conductive member is provided at any human body contacting portion which is other than the main body holding portion such as the belt 93 and the handle 27 holding the main body portion 21 and with which a user is in contact almost always during use.

Further, the potential of the static electricity significantly exceeds the potential generated in the circuit board 29 by the secondary battery 25 and is accumulated in the same manner as the whole at conductive parts. Accordingly, the contact pattern 67 and the contact position 90 are capable of receiving an electrostatic charge even when disposed in proximity to a different position in the pattern 66 (such as the conductive pattern 66*a*) or another conductive part not limited to the ground pattern 66*b* of the circuit board 29. As a result, the function and effect of the embodiments described above can still be achieved.

The circuit board 29 is not limited to being disposed in the handle 27. The circuit board 29 may be disposed as the control device 24 or may be any other circuit board.

The vacuum cleaner 11 is a suction cleaner according to the above description. In an alternative example, the vacuum cleaner 11 may be a blower using the exhaust of the electric blower 23 or may be configured such that both the suction cleaner and the blower can be used by means of air duct switching etc.

The electrical equipment is not limited to a blower or a suction cleaner using the electric blower 23. In an alternative example, the electrical equipment may be a polisher which is driven to rotate by an operating unit such as a motor to generate static electricity by friction. The electrical equipment is not limited to the vacuum cleaner, and may be a voluntary equipment which generates static electricity by friction.

According to the one or more embodiments described above, it is possible to provide the easy-to-use vacuum cleaner 11 effectively releasing static electricity while adopting a cordless configuration using the secondary battery 25.

Some embodiments of the invention have been described above. The embodiments have been presented as an example. The embodiments do not limit the scope of the invention. These novel embodiments can be implemented in various other forms and various omissions, substitutions, and changes can be made without departing from the gist of the invention. The embodiments and modifications of the embodiments are included in the scope and gist of the invention and are included in the invention described in the claims and equivalent scopes.

What is claimed is:

1. An electrical equipment, comprising:

a main body portion;

a battery disposed in the main body portion;

an operating unit which operates by electric power supply from the battery;

a handle that is a human body contacting portion which a user contacts in gripping the handle when the electrical equipment is used;

a conductive member at least a part of which is disposed in the handle and is exposed outside the handle; and a circuit board having a predetermined pattern, wherein the conductive member or a pattern connected to the conductive member electrically and the predetermined pattern of the circuit board are disposed at a predetermined distance from each other, and within the predetermined distance, dielectric breakdown of air is caused between the conductive member or the pattern connected to the conductive member electrically and the predetermined pattern by receiving a potential of static electricity from the predetermined pattern and micro discharge is performed via the conductive member and a user gripping the handle.

2. The electrical equipment according to claim 1, wherein the handle is a main body holding portion which holds the main body portion.

3. The electrical equipment according to claim 2, wherein at least a part of the conductive member is provided at a lower portion of the handle.

4. The electrical equipment according to claim 3, wherein the handle is provided with an uneven slip resistance portion at the lower portion of the handle, and at least a part of the conductive member is disposed so as to be substantially flush with a projecting shape of the slip resistance portion of the handle.

5. The electrical equipment according to claim 2, wherein the handle is provided with an uneven slip resistance portion at a lower portion of the handle, and at least a part of the conductive member is disposed so as to be substantially flush with a projecting shape of the slip resistance portion of the handle.

6. The electrical equipment according to claim 1, further comprising a connecting portion which is connected to the main body portion, wherein the handle is a connecting gripping portion which grips the connecting portion.

7. The electrical equipment according to claim 1, wherein the human body contacting portion is composed of the conductive member.

8. The electrical equipment according to claim 1, wherein the conductive member is disposed on an outer surface of the human body contacting portion.

9. The electrical equipment according to claim 1, wherein the conductive member is a carbon-containing member.

10. The electrical equipment according to claim 1, wherein the conductive member is a conductive soft member.

11. The electrical equipment according to claim 1, wherein the handle is formed in an elongated shape, and at least a part of the conductive member is provided at positions in a longitudinal direction of the handle.

12. The electrical equipment according to claim 1, wherein the handle is formed in an elongated shape, and at least a part of the conductive member is provided in a substantially middle portion in a longitudinal direction of the handle.

13. The electrical equipment according to claim 1, wherein at least a part of the conductive member is disposed so as to be substantially flush with the handle.

14. A vacuum cleaner comprising the electrical equipment according to claim 1.

15. The vacuum cleaner according to claim 14, further comprising a connecting portion which is connected to the main body portion, wherein the handle is a connecting gripping portion which grips the connecting portion, and the connecting portion is an air duct body provided with a hose body.

* * * * *